US006811342B2

(12) United States Patent
Pauchet

(10) Patent No.: US 6,811,342 B2
(45) Date of Patent: Nov. 2, 2004

(54) SYSTEM FOR APPLYING A COMPOSITION ON A SURFACE ELEMENT

(75) Inventor: Bernard Pauchet, Saint Capraise de Lalinde (FR)

(73) Assignee: Taiki Corporation, Ltd., Osaka (JP)

( * ) Notice: Subject to any disclaimer, the term of this patent is extended or adjusted under 35 U.S.C. 154(b) by 0 days.

(21) Appl. No.: 10/258,590

(22) PCT Filed: May 9, 2001

(86) PCT No.: PCT/FR01/01393

§ 371 (c)(1),
(2), (4) Date: Nov. 1, 2002

(87) PCT Pub. No.: WO01/84977

PCT Pub. Date: Nov. 15, 2001

(65) Prior Publication Data

US 2003/0105425 A1 Jun. 5, 2003

(30) Foreign Application Priority Data

May 9, 2000 (FR) ..... 00 05874

(51) Int. Cl.[7] ..... B43K 5/14

(52) U.S. Cl. ..... 401/135; 401/132; 604/3; 222/83; 222/541.2

(58) Field of Search ..... 401/132–135; 604/3; 222/80, 83, 541.1, 541.2

(56) References Cited

U.S. PATENT DOCUMENTS 2,642,065 A * 6/1953 Negri ..... 604/3
3,450,129 A 6/1969 Avery et al.
3,786,820 A * 1/1974 Kopfer ..... 132/74.5
4,206,843 A 6/1980 Rainey
4,211,323 A * 7/1980 Olsen ..... 206/210
4,747,719 A 5/1988 Parkin
4,957,385 A * 9/1990 Weinstein ..... 401/132
5,120,301 A 6/1992 Wu
5,445,462 A * 8/1995 Johnson et al. ..... 401/132

FOREIGN PATENT DOCUMENTS

WO 97/19721 6/1997

* cited by examiner

*Primary Examiner*—Gene Mancene
*Assistant Examiner*—Huyen Le
(74) *Attorney, Agent, or Firm*—Richard M. Goldberg

(57) ABSTRACT

The invention provides a transportable applicator system in intended in particular for applying a composition on a localized surface element. It comprises a main body (10) extended by a rod handle (12) and a receptacle (14) in which said main body (10) is suitable for being inserted. The applicator system comprises: a puncturable container (18) containing said composition and held in said receptacle (14); applicator means (13) for applying said composition and secured to the end of said main body; and means (22, 20) for puncturing said container (18) when the main body (10) is forced into said receptacle (14) so as to puncture said puncturable container (18), whereby said applicator means (13) are suitable for being impregnated with said composition.

14 Claims, 3 Drawing Sheets

SYSTEM FOR APPLYING A COMPOSITION ON A SURFACE ELEMENT

The present invention relates to a transportable applicator system intended in particular for applying a composition on a localized surface element. More particularly, the present invention relates to an application system that is discardable after a few uses.

An intended field of application lies particularly but not exclusively in the field of makeup.

Devices are known that are constituted by a rod having a cap-forming handle at one end and having an applicator at its other end, said applicator being insertable into a cylindrical container whose edges co-operate with said cap-forming handle so as to hold said applicator in the composition and so as to close the container hermetically. This hermetic sealing characteristic is essential in order to avoid the solvent of the composition evaporating, and for this purpose, the cap-forming handle screws onto the cylindrical container.

Thus, after unscrewing the cap-forming handle of the cylindrical container, the user withdraws the applicator impregnated in composition to apply it to the desired location.

Nevertheless some applications, e.g. in cosmetics, require a large number of product samples to be prepared in order to carry out tests or to promote said products. The conventional way of making a container combined with a cap that closes it hermetically is relatively expensive, given the function of samples which are intended to contain only a small quantity of the composition to be applied.

A first object of the present invention is to provide a system for applying a cosmetic composition, the system containing a small volume of said composition hermetically stored in the system and being inexpensive to make.

To achieve this object, the invention provides a transportable applicator system for use in particular in applying a composition on a localized surface element, the system comprising a main body extended by a rod handle and a receptacle in which said main body is suitable for being inserted, the system being characterized in that it comprises:

- a puncturable container containing said composition and held in said receptacle;
- applicator means for applying said composition and secured to the end of said main body; and
- puncturing means for puncturing said container when the main body is forced into said receptacle so as to puncture said puncturable container, whereby said applicator means are suitable for being impregnated with said composition.

Thus, the composition to be applied is contained in a container that can be perforated. Standard containers of that type can contain a wide variety of compositions in small quantity and they are perfectly hermetic. Furthermore, they present the advantage of being easily perforated to release the composition they contain.

It will be understood that the container is inserted in a receptacle having the shape of a prior art cylindrical container but there is no longer any need for the receptacle to be closed hermetically by a cap-forming applicator element since the puncturable container is itself hermetically sealed. Thus, the cost of making such a receptacle is lower than the cost of making such a conventional cylindrical container.

In order to apply the composition, the system has applicator means at the end of the main body which is suitable for being engaged in the receptacle. The system also has means for puncturing the container in order to impregnate the applicator means, and said means are operated by forcing the main body into the receptacle.

Preferably, the applicator system further comprises deformable connection means suitable for holding said main body in said receptacle and for guiding it when the main body is forced into said receptacle to puncture said tank and bring said applicator means into the vicinity of said punctured container.

This characteristic makes it possible to secure the main body to the receptacle without there being any need to implement a screw system, and is therefore relatively less expensive, the main body and the receptacle being suitable for being molded out of plastics material.

In a preferred embodiment, the means for puncturing said puncturable container are situated close to said container so as to be driven against said container in order to puncture it when said main body bearing against said puncturing means is forced into said receptacle.

As explained in greater detail below, in this preferred embodiment, the means for puncturing the container are situated between the container and the main body when it is inserted into the receptacle. Thus, when the main body is pushed into the receptacle, it drives the puncturing means which compress the surface of the container in order to puncture it.

In another preferred embodiment of the invention, the applicator system further comprises an element for transferring said composition situated between said puncturable container and said applicator means and suitable for transferring said composition by capillarity from the punctured container to said applicator means.

This characteristic enables the composition contained in the puncturable container to be spread uniformly over the applicator means once the container has been punctured.

According to an advantageous characteristic, the deformable connection means comprise breakable fixing means suitable for being broken by forcing said main body into said receptacle, whereby said main body is held in a fixed position in said receptacle.

This advantageous characteristic makes it possible to fix the main body temporarily in the receptacle prior to using the system. Thus, it is only when the main body is pushed into the receptacle to puncture the container that the breakable fixing means are broken. This characteristic also makes it possible to ensure that the container has not previously been punctured.

In another advantageous characteristic, the means for puncturing said puncturable container are constituted by a sleeve suitable for sliding in said receptacle, said sleeve having grid-forming means at one of its ends, and being placed in such a manner that the end having said grid-forming means is situated facing said puncturable container, and said main body is suitable for bearing against the other of said ends of said sleeve, said applicator means penetrating at least partially into said sleeve.

Thus, the puncturable container is initially inserted into the bottom of the receptacle and then the sleeve is slid into the receptacle so that the grid-forming means come close to the container. It will be understood that the diameter of the container is perceptibly smaller than the diameter of the receptacle and that the sleeve is of a diameter that is substantially equal to that of the container. As a result, the main body which is held against the sleeve can drive it in such a manner that the grid-forming means puncture the container.

Advantageously, the transfer means are constituted by a foam element housed in said sleeve in such a manner that said foam element comes into contact with the applicator means and with said composition, which composition passes through said grid-forming means when said puncturable container is punctured.

It will be understood that the foam element housed in the sleeve is in contact with the applicator means since it penetrates at least in part into said sleeve. When the main body is pushed into the receptacle, it bears against the edge of the sleeve and causes the grid-forming means to press against the container which perforates it once it has been pushed in far enough. Since the applicator means are in contact with the foam element and the composition migrates into said foam element through the grid-forming means, the applicator means are impregnated with the composition contained in the container.

In a particular embodiment of the invention, the applicator means and said means for puncturing said container are constituted by a single part. Thus, by appropriately selecting the nature of the applicator means and in particular their hardness, they are suitable for puncturing the container directly by pushing the main body into the receptacle.

In a preferred embodiment of the invention, the means for puncturing said container are connected to said receptacle by said deformable connection means. Thus, when the main body is driven in translation freely relative to the receptacle, it drives the puncturing means by deforming the deformable connection means.

Advantageously, said puncturable container is constituted by a breakable closed capsule containing said composition. As a result, the container can be mass produced and can be inserted into the applicator system during assembly thereof.

Preferably, said puncturable container is formed by said receptacle being closed between the end wall of said receptacle and its open end by a breakable membrane, said composition being contained between said end wall and said membrane. Thus, the inside wall of the container constitutes a significant fraction of the wall of the container and is not itself puncturable. The puncturable portion is constituted by a breakable membrane held hermetically against the inside wall of the receptacle and holding the composition captive in the end of the receptacle.

According to a particular advantageous characteristic, said main body has a first portion presenting said applicator means, and a removable second portion comprising said rod. Thus, the second portion is itself suitable for being connected or disconnected relative to the first portion.

Preferably, said first portion of said main body comprising said applicator means is secured to said puncturing means. As a result, when the puncturing means are connected to the receptacle, the first portion of the main body is secured to the receptacle, the second portion comprising the rod being capable of being assembled to the first portion.

In a second aspect, the present invention provides a transportable applicator kit comprising a plurality of transportable applicator systems, each of said receptacles containing a composition, each receptacle having means for puncturing said container and a first portion of said main body provided with said applicator means; and said second portion comprising said handle is suitable for being mounted on the first portions fitted with said applicator means in order to puncture said puncturable container and impregnate them with the composition. Thus, the second proton of the main body extended by the rod is removable and a single second portion suffices for applying the various compositions contained in the plurality of transportable applicator systems.

Other features and advantages of the invention appear on reading the following description of particular embodiments of the invention given by way of non-limiting indication, with reference to the accompanying drawings, in which.

Figure 1:
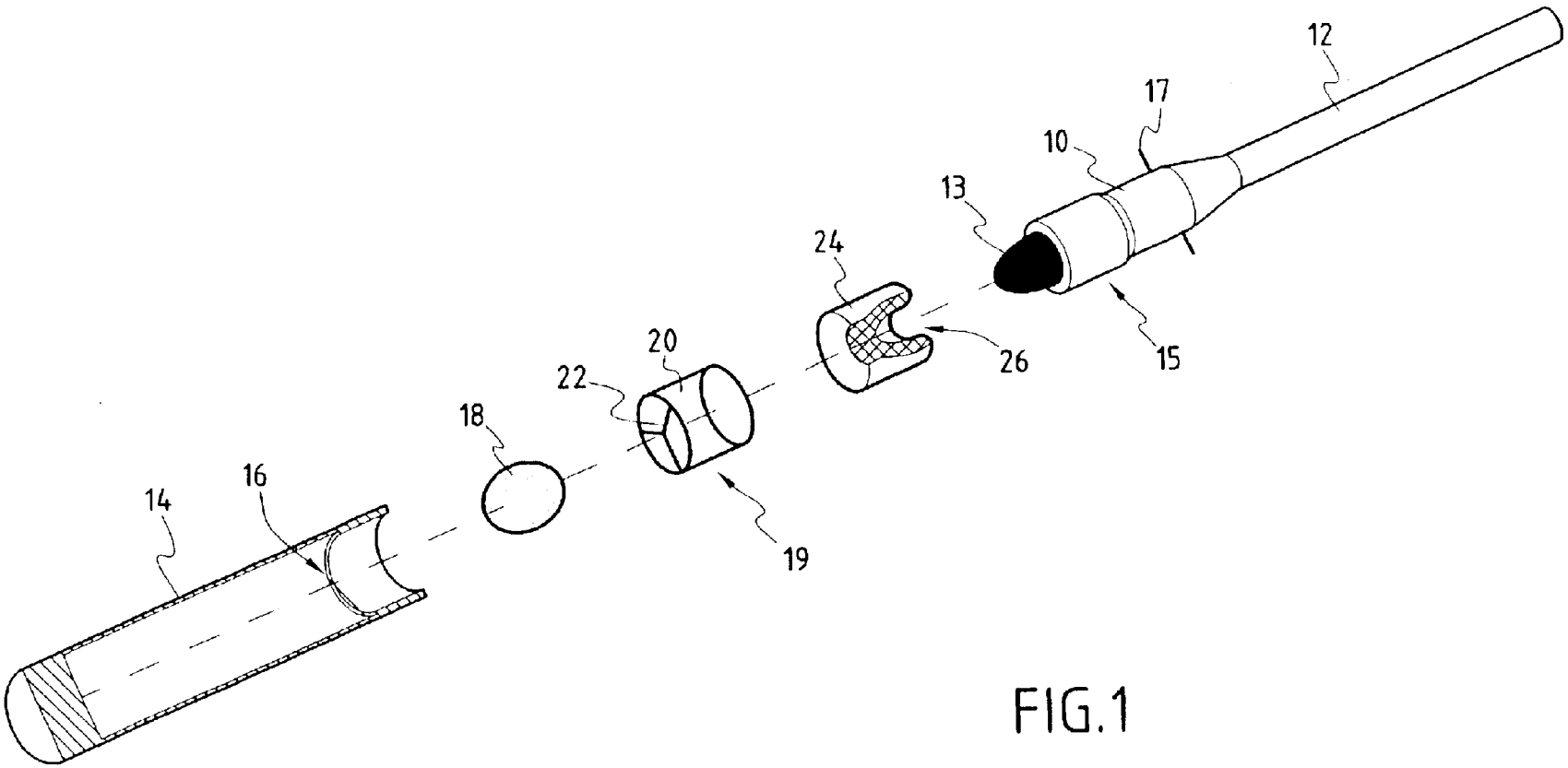
FIG. 1 is a diagrammatic view exploded along the assembly axis showing an applicator system in accordance with the invention.

Reference is made initially to FIG. 1 to give a general description of the applicator system in accordance with the invention.

The system comprises a main body 10 with cylindrical symmetry, extended by a handle rod 12 of diameter smaller than that of the main body 10. The handle rod 12 and the main body 10 constitute a single piece of moldable plastics material.

The main body 10 is provided with applicator means 13 at one end. The applicator means 13 are made of foam, being cylindrically symmetrical, and they enable the composition to be applied to a localized surface element, and for this purpose they present a tapering end that is bullet-shaped.

The foam used is preferably extremely soft, so as to avoid irritating the skin of the user applying the composition to the skin.

The system also has a receptacle 14 or cap that is likewise cylindrically symmetrical and that presents a first end that is open and a second end that is closed. The main body 10 of the system is suitable for being inserted into the receptacle 14 and for closing the open first end.

Thus, the main body 10 has an outside diameter that is perceptibly smaller than the inside diameter of the receptacle 14. Furthermore, the applicator system further comprises deformable connection means for holding the main body 10 in the receptacle 14.

These connection means comprise a groove 15 formed around the periphery of the main body 10 co-operating with a rib 16 situated on the inside wall of the receptacle 14. Advantageously, the main body 10 and the receptacle 14 are made of molded plastics material, thus enabling relative elasticity to be obtained between the groove 15 and the rib 16, leading to a connection that is elastically deformable.

In addition, the deformable connection means have breakable fixing means 17 pressing against the open end edge of the receptacle 14. The main body 10 can be fully inserted into the receptacle 14 only by breaking the breakable fixing means 17. In FIG. 1, the breakable fixing means are connected solely to the main body 10, but they could also be secured to the end edge of the receptacle 14 in the assembled system. Thus, the main body 10 is held in a position that is fixed relative to the receptacle 14 and reveals whether or not the system has already been used.

The applicator system is intended to apply a composition that it contains, in particular a cosmetic composition. Such compositions are generally liquid and suitable for being stored in a substantially spherical container having a capacity of about one millileter or one-tenth of a millileter. Such containers are generally made of a plastics material of the polyurethane or polyethylene type and they are capable of being punctured or burst under the action of pressure being exerted on the wall thereof, thereby releasing the content. Such containers are also hermetic with respect to the solvents that are generally contained therein.

Thus, the applicator system of the invention comprises a puncturable container 18 in which the composition for application is contained. The puncturable container 18 containing the composition is placed in the end of the receptacle 14. Advantageously, it is held in place against the end wall of the receptacle 14 by adhesive, but it could also be left free, since the other elements of the applicator system as described below close the receptacle 14 and hold the puncturable container 18 captive.

The receptacle 14 also has means 19 for puncturing the container 18, said means being situated above it so that the container 18 is interposed between the end wall of the receptacle 14 and the means 19 for puncturing it.

The means 19 for puncturing the puncturable container 18 are constituted by a sleeve 20 of outside diameter perceptibly smaller than the inside diameter of the receptacle 14 so as to be capable of sliding therein. These means are also constituted by grid-forming means 22 fixed to the end of the sleeve 20 so that the mean plane of said grid-forming means 22 extends perpendicularly to the axis of the sleeve 20. The grid-forming means 22 are formed by a three-branch cross-member with the ends of the branches being connected to the edge of the sleeve 20 at one of its ends. Naturally, any other shape of grid-forming means 22 would be suitable.

The puncturing means 19 are inserted into the receptacle 14 above the puncturable container 18 so that the end of the sleeve 20 carrying the cross-member faces the puncturable container 18.

The applicator system of the invention further comprises an element 24 for transferring the composition, said element being made of porous material. This foam transfer element 24 is cylindrically symmetrical and its dimensions are such that it can be received in full inside the sleeve 20, bearing at one of its ends against the grid-forming means 22.

At its opposite end, it preferably presents a recess 26 into which the applicator means 13 are suitable for being engaged, thereby penetrating at least partially into the sleeve 20. Furthermore, and advantageously, the transfer element 24 has an axial channel for facilitating transfer of the composition by capillarity.

Figure 2:
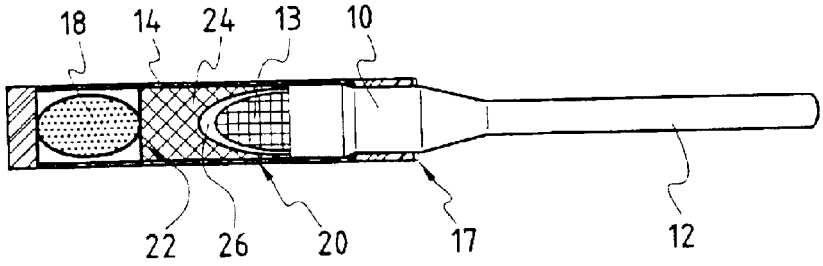
FIG. 2 is a section view showing the applicator system prior to use with the breakable fixing means still intact.

With reference now to FIG. 2, there follows a description of the assembled applicator system in accordance with the invention prior to use.

In FIG. 2, there can be seen the main body 10 partially inserted into the receptacle 14 so that the breakable fixing means 17 bear against the open end edge of the receptacle 14. The puncturable container 18 is held in the opposite end of the receptacle 14 by the grid-forming means 22 situated at the end of the sleeve 20, into which the transfer element 24 is inserted.

Figure 3:
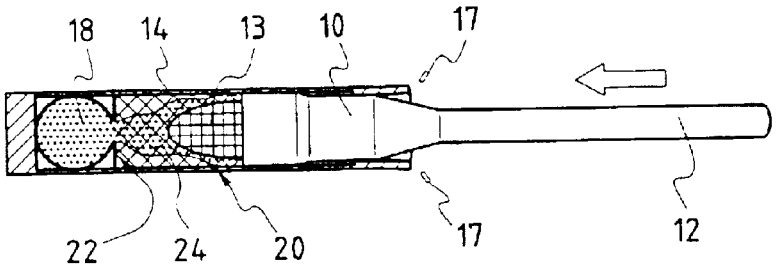
FIG. 3 is a section view showing the applicator system when the main body is forced into the receptacle and the container is punctured.

With reference to FIG. 3, there follows a description of the applicator system when the main body 10 is forced into the receptacle 14. Forcing the main body 10 into the receptacle 14 initially causes the breakable fixing means to break, which then become disconnected from the main body 10. Thereafter, the main body 10 is pressed against the edge of the sleeve 20 and the applicator means 13 are pressed against the transfer element 24. The solid thrust of the main body 10 against the sleeve 20 drives the sleeve together with the grid-forming means 22 against the puncturable container 18 which in turn bears against the end wall of the receptacle 14. The grid-forming means 22 thus puncture the wall of the puncturable container 18, thereby releasing the composition contained therein. The composition impregnates the transfer element 24 which, by capillarity, transfers it to the applicator means 13. The main body 10 should be held inside the receptacle 14 after it has been forced into it for a length of time that is sufficient to enable good impregnation to take place, i.e. about one second. Because of the tapering shape of the applicator means 13 co-operating with the transfer element 24 that presents a recess 26, the composition covers the surface of the applicator means 13 uniformly where it makes contact with the transfer element 24. Thus, the composition is easier to apply to the surface in question.

Figure 4:
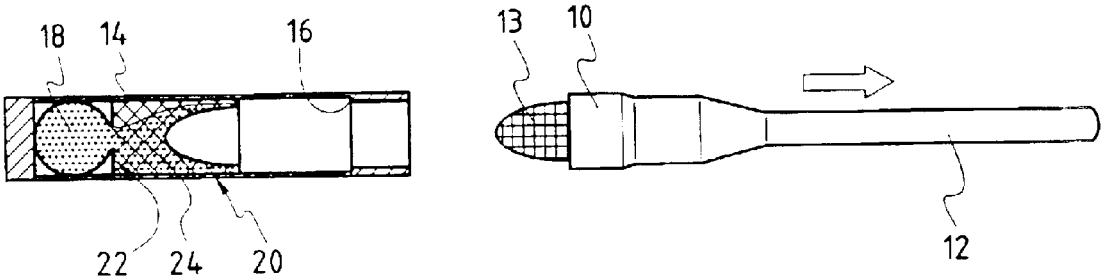
FIG. 4 is a section view showing the applicator system when the main body fitted with the applicator means is withdrawn from the receptacle.

FIG. 4 shows the main body 10 fully disengaged from the receptacle 14 so as to enable the composition to be applied to a suitable surface element.

After first use, the applicator system can be reused a second time providing the composition is not transferred in full to the applicator means 13 on the first occasion. To do this, the main body 10 is reinserted into the receptacle 14. Second use need not take place immediately after first use, and the deformable connection means, and in particular the groove 15 and the rib 16, enable the main body 10 to be held in the receptacle 14 until said second use without the solvent of the composition evaporating.

In a particular embodiment, in order to keep costs low, the applicator means and the means for puncturing the container are constituted by a single part. Thus, the applicator means are made out of a material that is relatively rigid so as to be capable of puncturing the puncturable container that contains the composition without requiring any additional part.

The applicator system of the invention relates essentially to discardable systems for applying cosmetic compositions or medicinal compositions.

In another aspect, the present invention also provides a transportable applicator kit, comprising a plurality of transporter applicator systems, and the kit is described below with reference to FIGS. 5 and 6.

Figure 5:
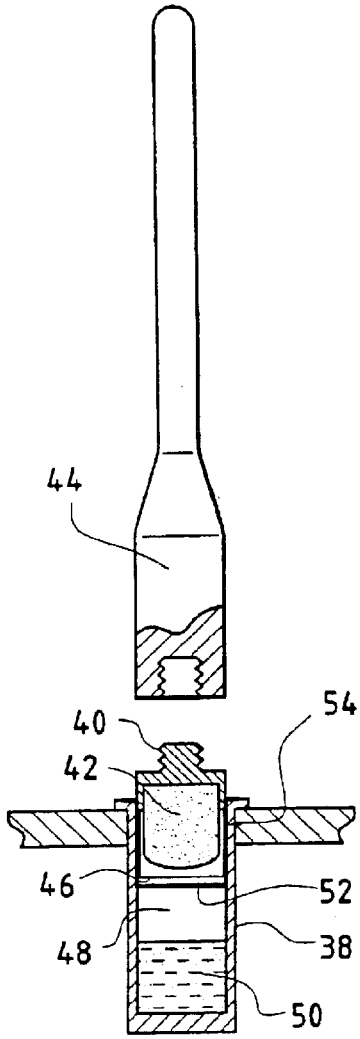
FIG. 5 is a vertical section view of a removable main body in accordance with the invention.

FIG. 5 shows an applicator system comprising a receptacle 38 and a removable main body presenting a first portion 40 having applicator means 42 and a second portion 44 comprising said rod. The second portion 44 can be screwed onto the first portion 40 which is itself engaged in means 46 for puncturing a puncturable container 48, said puncturable container 48 being formed by the receptacle 38 itself.

The composition 50 is contained in the bottom of the receptacle which is closed by a breakable membrane 52. The edge of the breakable membrane 52 is applied in hermetic manner against the inside wall of the receptacle so as to isolate the composition 50 from the outside of the receptacle 38.

The means 46 for puncturing said container 48 are connected to said receptacle 38 by deformable connection means 54, and said first portion 40 of said main body comprising said applicator means 42 is secured to said means so as to achieve puncturing 46. Thus, the second portion 44 of the main body is suitable for being mounted on the first portion 40, and when the main body is forced into the receptacle, it drives the puncturing means 46 and deforms the deformable connection means 54. As a result, the breakable membrane 52 situated close to the puncturing means 46 is punctured and the applicator means 42 are brought into contact with the composition 50 so as to be impregnated therewith.

Thereafter, the main body is withdrawn from the receptacle 38 by means of the second portion 44 of the main body as extended by the rod.

Figure 6:
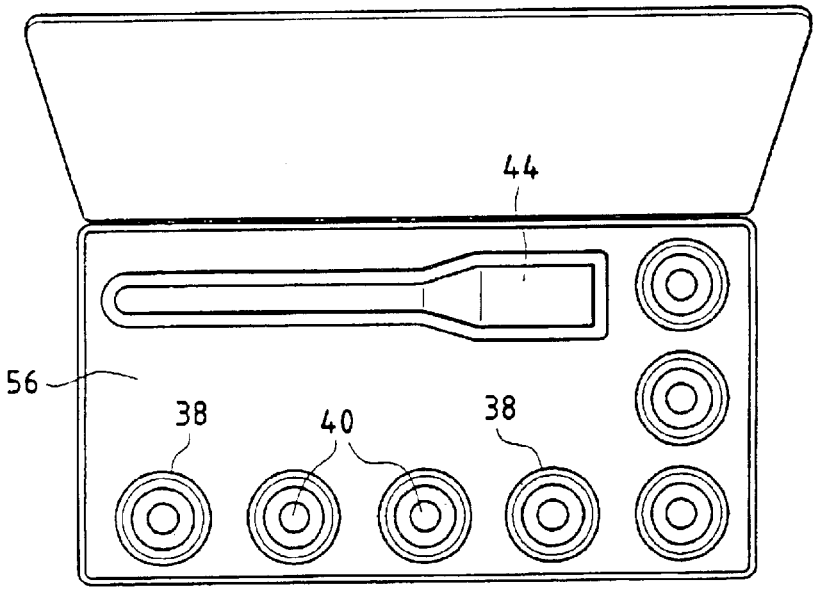
FIG. 6 is a plan view of an applicator kit in accordance with the invention.

FIG. 6 shows an applicator kit in accordance with the invention, said receptacles 38 being inserted in a box 56.

Each receptacle 38 has means for puncturing said container and a first portion of said main body 40 provided with said applicator means, and visible in FIG. 6. Said second portion 44 comprising said rod is housed in the box 56 beside the receptacles 38. As a result, the transportable applicator kit can contain a plurality of receptacles containing different compositions for application, application thereof being performed independently using the second portion 44 which can be mounted for this purpose on any one of the first portions 40 constituting a main body.

In another particular embodiment of the applicator kit in accordance with the invention, the puncturable container is constituted by a breakable closed capsule containing said composition and placed in the bottom of a receptacle.

Naturally, the applicator kit in accordance with the invention is equally suitable for receiving both medicinal compositions and cosmetic compositions.

What is claimed is:

1. A transportable applicator system for applying a composition on a localized surface element, the system comprising:

a main body having an end and extended by a rod handle;

a receptacle constructed to receive said end of said main body for insertion therein;

a puncturable container containing said composition and held in said receptacle;

an applicator for applying said composition and secured to said end of said main body; and a puncturing arrangement for puncturing said container when said end of the main body provided with said applicator is forced into said receptacle so as to puncture said puncturable container, whereby said applicator is impregnated with said composition.

2. A transportable applicator system according to claim 1, wherein said puncturing arrangement is situated close to said container in such a manner as to be driven against said container to puncture said container when said main body, bearing against said puncturing arrangement, is forced into said receptacle.

3. A transportable applicator system according to claim 1, wherein said applicator and said puncturing arrangement comprise a single part.

4. A transportable applicator system according to claim 1, wherein said puncturable container comprises a breakable closed capsule containing said composition.

5. A transportable applicator system according to claim 1, wherein said main body has a first portion provided with said applicator, and a second portion that is removable and provided with said handle.

6. A transportable applicator system according to claim 5, wherein said first portion of said main body is secured to said puncturing arrangement.

7. A transportable applicator system for applying a composition on a localized surface element, the system comprising:

a main body having an end and extended by a rod handle;

a receptacle in which said main body is constructed and arranged for insertion;

an puncturable container containing said composition and held in said receptacle;

an applicator for applying said composition and secured to said end of said main body;

a puncturing arrangement for puncturing said container when said main body is forced into said receptacle so as to puncture said puncturable container, whereby said applicator is impregnated with said composition; and a deformable connection for holding said main body in said receptacle and for guiding said main body when the main body is forced into said receptacle to puncture said container and bring said applicator into the vicinity of said punctured container.

8. A transportable applicator system according to claim 7, wherein said puncturing arrangement is connected to said receptacle by said deformable connection.

9. A transportable applicator system according to claim 7, wherein said deformable connection. comprises a breakable fixing arrangement suitable for being broken by forcing said main body into said receptacle, whereby said main body is held in a fixed position in said receptacle.

10. A transportable applicator system for applying a composition on a localized surface element, the system comprising:

a main body having an end and extended by a rod handle;

a receptacle in which said main body is constructed and arranged for insertion;

a puncturable container containing said composition and held in said receptacle;

an applicator for applying said composition and secured to said end of said main body; and a puncturing arrangement for puncturing said container when said main body is forced into said receptacle so as to puncture said puncturable container, whereby said applicator is impregnated with said composition, said puncturing arrangement comprising a sleeve having two ends and sliding in said receptacle, said sleeve having a grid-forming arrangement at one of said ends, and being placed in such a manner that the end having said grid-forming arrangement is situated facing said puncturable container, and said main body is constructed and arranged for bearing against the other of said ends of said sleeve, said applicator penetrating at least partially into said sleeve.

11. A transportable applicator system for applying a composition on a localized surface element, the system comprising:

a main body having an end and extended by a rod handle;

a receptacle in which said main body is constructed and arranged for insertion;

a puncturable container containing said composition and held in said receptacle;

an applicator for applying said composition and secured to said end of said main body;

a puncturing arrangement for puncturing said container when said main body is forced into said receptacle so as to puncture said puncturable container, whereby said applicator is impregnated with said composition; and a transfer device disposed between said puncturable container and said applicator, for transferring said composition by capillarity from said punctured container to said applicator.

12. A transportable applicator system according to claim 11, wherein said transfer device comprises a foam element housed in said sleeve in such a manner that said foam element comes into contact with the applicator and with said composition, whereby said composition passes through said grid-forming arrangement when said puncturable container is punctured.

13. A transportable applicator system for applying a composition on a localized surface element, the system comprising:

a main body having an end and extended by a rod handle;

a receptacle in which said main body is constructed and arranged for insertion;

a puncturable container containing said composition and held in said receptacle, said puncturable container being formed by said receptacle which is closed by an end wall of said receptacle and by a breakable membrane mounted at an open end of said receptacle, said composition being contained between said end wall and said membrane;

an applicator for applying said composition and secured to said end of said main body; and a puncturing arrangement for puncturing said container when said main body is forced into said receptacle so as to puncture said puncturable container, whereby said applicator is impregnated with said composition.

14. A transportable applicator kit, comprising:

a main body having a first portion, and a second portion that is removable from said first portion and provided with a rod handle;

a plurality of transportable applicator systems each transportable applicator system for applying a composition on a localized surface element, comprising:

a receptacle in which said main body is constructed and arranged for insertion;

a puncturable container containing said composition and held in said receptacle;

an applicator for applying said composition and secured to said first portion of said main body;

each receptacle having a puncturing arrangement for puncturing said container formed by said first portion of said main body provided with said applicator, said puncturing arrangement puncturing said container when said first and second portions are connected together and said main body is forced into said receptacle, whereby said applicator is impregnated with said composition; and said second portion comprising said handle being constructed and arranged for mounting on the first portion fitted with said applicator in order to puncture said puncturable container and impregnate the applicator with the composition.

* * * * *